US010646905B2

(12) United States Patent
Cole et al.

(10) Patent No.: US 10,646,905 B2
(45) Date of Patent: May 12, 2020

(54) MODULAR GUIDE HOSE SYSTEM FOR PLUMBING TOOLS

(71) Applicant: Ridge Tool Company, Elyria, OH (US)

(72) Inventors: Alex M. Cole, Columbia Station, OH (US); Michael J. Rutkowski, Locust Grove, VA (US); Josh Sooy, North Ridgeville, OH (US)

(73) Assignee: Ridge Tool Company, Elyria, OH (US)

( * ) Notice: Subject to any disclaimer, the term of this patent is extended or adjusted under 35 U.S.C. 154(b) by 275 days.

(21) Appl. No.: 15/456,423

(22) Filed: Mar. 10, 2017

(65) Prior Publication Data

US 2017/0266702 A1 Sep. 21, 2017

Related U.S. Application Data

(60) Provisional application No. 62/310,014, filed on Mar. 18, 2016.

(51) Int. Cl.

| | |
|---|---|
| ***B08B 9/045*** | (2006.01) |
| ***E03F 9/00*** | (2006.01) |
| ***E03C 1/302*** | (2006.01) |
| ***B65H 75/36*** | (2006.01) |
| ***B08B 9/043*** | (2006.01) |

(52) U.S. Cl.

CPC ..... *B08B 9/045* (2013.01); *B08B 9/0436* (2013.01); *B65H 75/364* (2013.01); *E03C 1/302* (2013.01); *E03F 9/005* (2013.01)

(58) Field of Classification Search

CPC ..... E03C 1/302; E03F 9/002; E03F 9/005; B08B 9/04; B08B 9/043; B08B 9/0436; B08B 9/045

USPC ..... 15/104.33

See application file for complete search history.

(56) References Cited

U.S. PATENT DOCUMENTS

| | | | | |
|---|---|---|---|---|
| 1,838,574 A * | 12/1931 | Ross | F16L 37/26 | 285/325 |
| 2,355,733 A * | 8/1944 | Johnson | E03F 9/005 | 15/104.095 |
| 2,468,490 A * | 4/1949 | Di Joseph | E03F 9/005 | 15/104.33 |
| 2,470,359 A * | 5/1949 | McLean | F16L 21/005 | 285/109 |

(Continued)

FOREIGN PATENT DOCUMENTS

| | | |
|---|---|---|
| CN | 105246599 A | 1/2016 |
| CN | 101631918 A | 9/2017 |

(Continued)

OTHER PUBLICATIONS

Search Report ; Application CN 201710160050.X; 2 pages.
Office Action dated Nov. 22, 2018; Application CN 201710160050.X; 4 pages.

*Primary Examiner* — Mark Spisich
(74) *Attorney, Agent, or Firm* — Mark E. Bandy; Rankin, Hill & Clark LLP

(57) ABSTRACT

A drain cleaning system is described that includes a drain cleaning device with a flexible drain cleaning cable, and two or more sections of guide hoses that can be attached to one another and/or to the device. Also described are systems that include provisions for advancing or retracting the drain cleaning cable and which can also be coupled to one or more of the guide hoses.

8 Claims, 8 Drawing Sheets

(56) References Cited

U.S. PATENT DOCUMENTS

| | | | | | |
|---|---|---|---|---|---|
| 3,159,861 | A * | 12/1964 | Sarcone | E03F 9/005 | 15/104.33 |
| 3,370,599 | A * | 2/1968 | Ciaccio | B08B 9/0433 | 134/167 C |
| 3,897,090 | A | 7/1975 | Maroschak | | |
| 4,364,140 | A | 12/1982 | Irwin | | |
| 4,570,281 | A * | 2/1986 | Boelens | B08B 9/045 | 15/104.33 |
| 5,403,046 | A * | 4/1995 | Kooten | F16L 27/12 | 285/319 |
| 5,624,139 | A * | 4/1997 | Van Kooten | F16L 27/12 | 285/239 |
| 5,975,111 | A | 11/1999 | Galantowicz et al. | | |
| 6,009,588 | A * | 1/2000 | Rutkowski | B08B 9/045 | 15/104.33 |
| 6,343,398 | B1 * | 2/2002 | Silverman | B08B 9/045 | 15/104.31 |
| 6,615,440 | B1 | 9/2003 | Williams | | |
| 7,278,662 | B1 * | 10/2007 | Bristor | F16L 15/00 | 285/272 |
| 7,765,626 | B2 | 8/2010 | Sapia | | |
| 8,312,572 | B2 | 11/2012 | Heffner | | |
| 2002/0083538 | A1 * | 7/2002 | Silverman | B08B 9/045 | 15/104.33 |
| 2005/0193509 | A1 * | 9/2005 | Rutkowski | B08B 9/045 | 15/104.33 |
| 2007/0089254 | A1 | 4/2007 | Alaine | | |
| 2008/0148503 | A1 | 6/2008 | Babb et al. | | |
| 2012/0018022 | A1 | 1/2012 | Davis et al. | | |
| 2013/0008471 | A1 | 1/2013 | Borkowski | | |

FOREIGN PATENT DOCUMENTS

| | | | |
|---|---|---|---|
| GB | 10662 | * | 2/1912 |
| WO | WO 2014/191824 | | 12/2014 |

* cited by examiner

MODULAR GUIDE HOSE SYSTEM FOR PLUMBING TOOLS

CROSS REFERENCES TO RELATED APPLICATIONS

This application claims priority from U.S. provisional application Ser. No. 62/310,014 filed on Mar. 18, 2016.

FIELD

The present subject matter relates to a modular or sectional guide hose system for plumbing tools, such as a drain cleaning tool. The present subject matter also relates to plumbing tools and particularly drain cleaning tools utilizing the modular guide hose system.

BACKGROUND

Plumbing tools that use a flexible drain cleaning cable or "snake" typically also use a guide hose that encloses and generally extends along the length of the drain cleaning cable. Guide hoses enclose the drain cleaning cable and prevent water and/or debris carried from a drain or piping system for example from contacting the operator, which can otherwise occur during retraction of the cable into the tool. In addition, guide hoses protect the drain cleaning cable from inadvertent contact with objects or the environment. Guide hoses also provide protection to an operator from the drain cleaning cable which may be moving rapidly or which could potentially "buckle" or form large segments of twisting cable during use.

Although generally useful and beneficial, guide hoses limit flexibility of a plumbing tool and/or its application. As will be appreciated, nearly every job site is unique and imposes varying requirements on a user such as length of cable and thus guide hose needed. Accordingly, a new strategy and system are needed which significantly improve flexibility and use of plumbing tools using guide hoses.

SUMMARY

The difficulties and drawbacks associated with previous approaches are addressed in the present subject matter as follows.

In one aspect, the present subject matter provides a drain cleaning system comprising a drain cleaning device including a rotatable drum, a flexible drain cleaning cable, and provisions for selectively advancing or retracting the cable relative to the drum. The drain cleaning system also comprises a first flexible guide hose coupled to the device and positioned to house the cable upon advancement from the drum. The drain cleaning system also comprises a second flexible guide hose selectively coupleable to the first guide hose.

In another aspect, the present subject matter provides a drain cleaning system comprising a drain cleaning device including a powered rotatable drum, and a flexible drain cleaning cable. The drain cleaning system also comprises a flexible guide hose coupled to the device and positioned to house the cable upon advancement from the drum. The drain cleaning system also comprises provisions for selectively advancing or retracting the cable relative to the drum, in which the provisions are selectively coupleable to a distal end of the hose.

In still another aspect, the present subject matter provides a drain cleaning system comprising a drain cleaning device including a powered drum and a flexible drain cleaning cable. The drain cleaning system also comprises a first flexible guide hose coupled to the device for housing the cable. And, the drain cleaning system also comprises a second flexible guide hose selectively coupleable to the first guide hose.

As will be realized, the subject matter described herein is capable of other and different embodiments and its several details are capable of modifications in various respects, all without departing from the claimed subject matter. Accordingly, the drawings and description are to be regarded as illustrative and not restrictive.

DETAILED DESCRIPTION OF THE EMBODIMENTS

Figure 1:
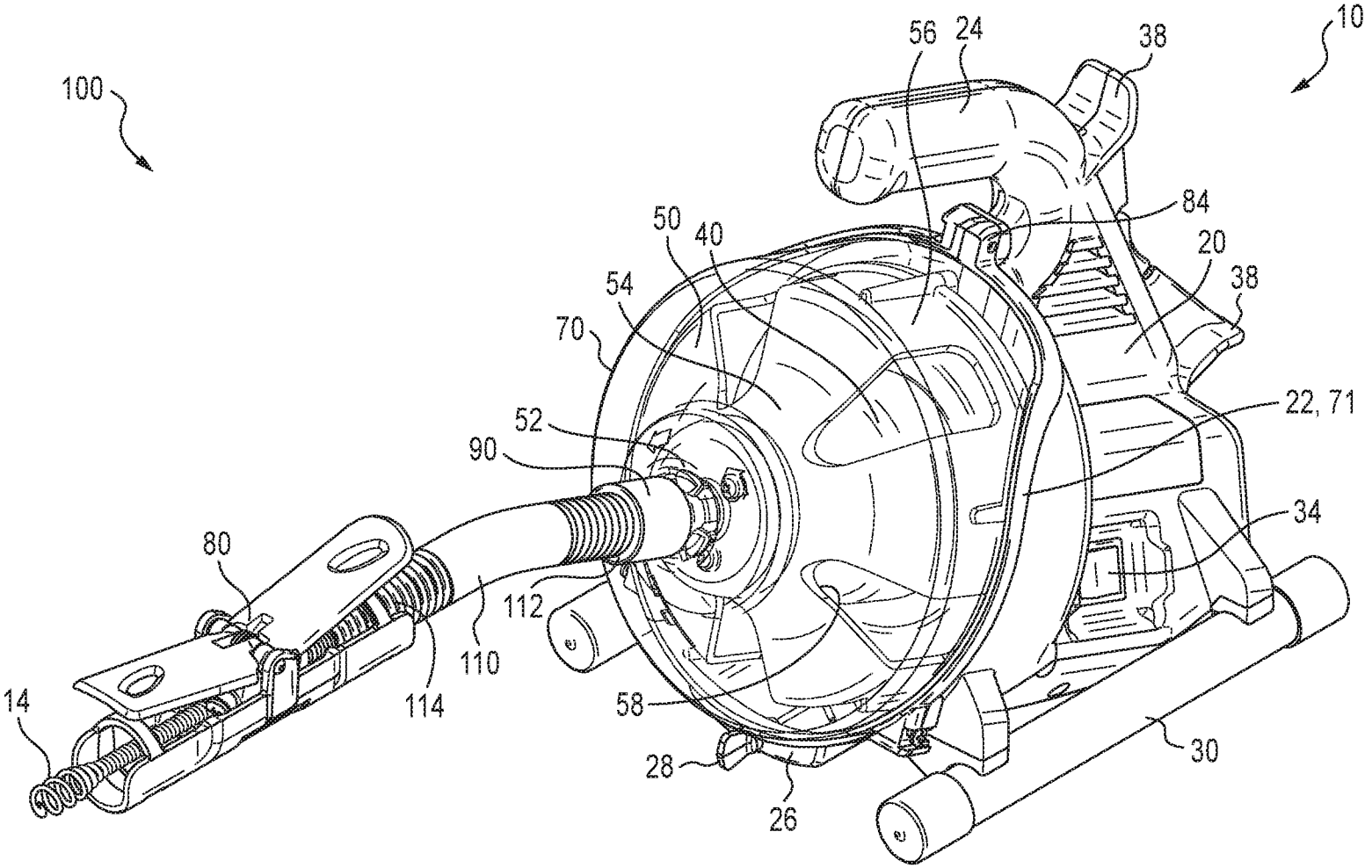
FIG. 1 is a perspective view of a drain cleaning tool having a modular guide hose system in accordance with the present subject matter.
Figure 2:
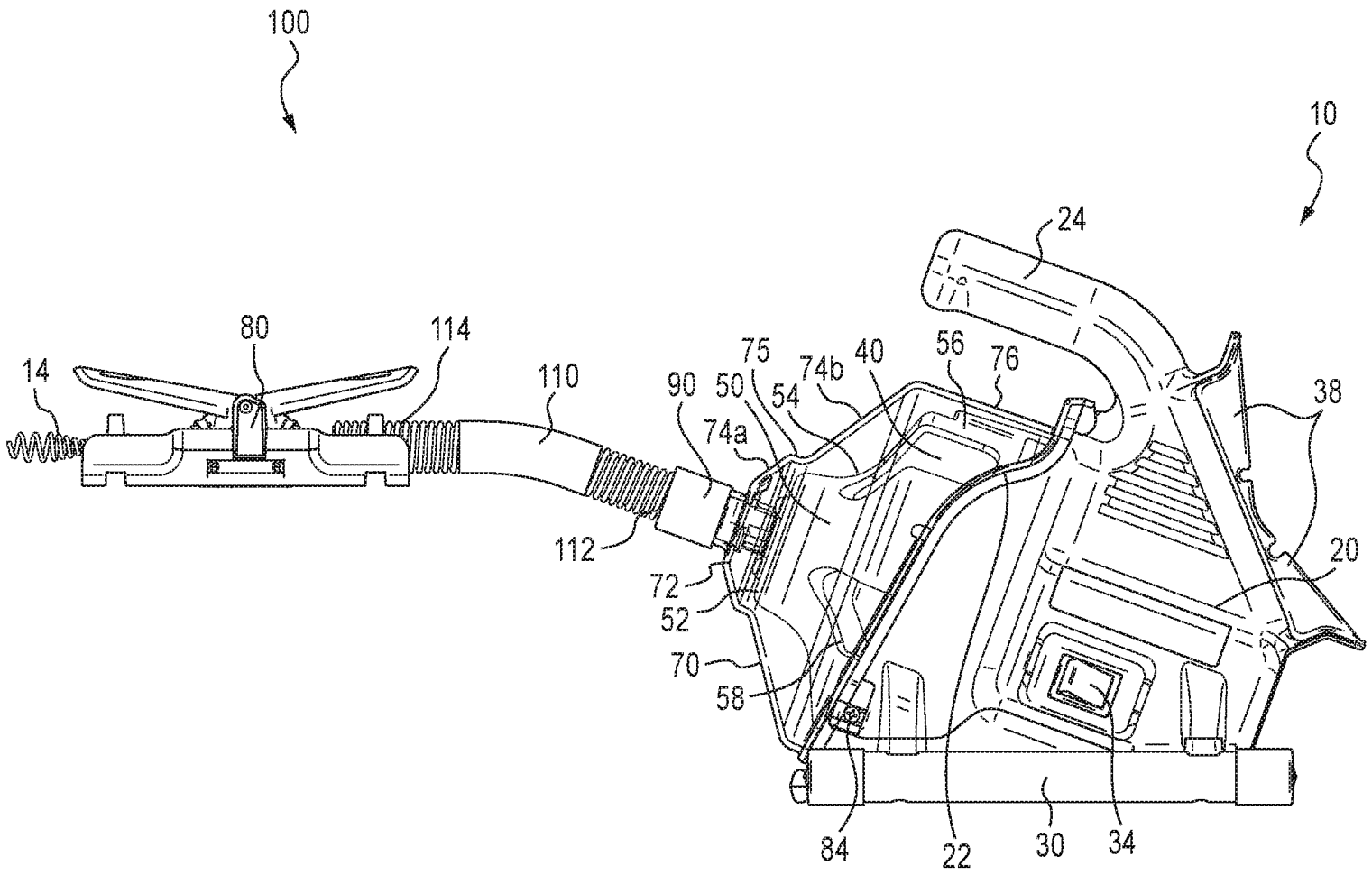
FIG. 2 is a side view of the drain cleaning tool and modular guide hose system shown in FIG. 1.

The present subject matter provides a modular guide hose system for plumbing tools. In many versions, the modular guide hose system includes provisions for selectively advancing or retrieving a drain cleaning cable. Such provisions are typically in the form of a feed mechanism or feed control device or "autofeed" which can be selectively coupled at any location along a collection of modular guide hoses coupled together to form a continuous length of guide hose. The system is particularly suited for use with rotary or drum style drain cleaners.

The present subject matter also provides a guide hose and/or a corresponding collection of guide hoses used to contain a cable from the outside environment while operating a drain cleaning device. With an autofeed on the end of the guide hose, the device can be placed a desired distance from the entrance to the drain to be cleaned giving the operator more flexibility.

Using a fixed length guide hose, an operator is limited to one setup which may not be the most efficient or ergonomic for the job. The environment often dictates where the device is positioned in relation to the drain entrance. If the device is close to the drain a long hose becomes cumbersome for the operator and the added friction between the cable and guide hose makes for more work on the operator and the device. The present subject matter provides a sectional guide hose system that allows the operator to customize the device for the application. A short hose can be used in instances where the drain and device are close to one another and a longer hose can be used when the device and drain are farther apart.

The guide hose is affixed to the front of the device and remains stationary while the cable rotates within the guide hose. A feed mechanism is attached to the end of the guide hose to allow the user to advance or retrieve cable out of or into the drum. This guide hose keeps the rotating cable contained and out of contact with the operator. The guide hose also helps to keep the work area clean by containing any material brought back by the cable.

With a modular guide hose the operator is able to better fit the guide hose to the application. In certain embodiments of the present subject matter, a short guide hose remains fixed to the feed mechanism. The opposite end of the guide hose has a female connection which mates with the device housing. An additional guide hose is fitted with a female coupling to mate with the housing on one end. The opposite end of the guide hose has the same male coupling as the housing in order to mate with the guide hose affixed to the feed mechanism. The present subject matter includes opposite configurations of male and female couplings.

The length of the guide hose on the feed mechanism is set to cover situations in which the drain and device are in close proximity. Additional length guide hoses allow for a situation in which the drain and device are further apart. Multiple additional guide hoses can be added to the system to optimize the device setup for any given situation.

Additional aspects or embodiments of the present subject matter allow for the feed mechanism to be mounted directly to the housing without a guide hose. The embodiments also include the ability to mount a length of guide hose to the front of the feed mechanism to provide even more flexibility to the drain cleaning process. Accommodations can be made to allow the feed mechanism to be mounted in the middle of two guide hoses or at some other intermediate location.

A significant benefit of the present subject matter is that it allows flexibility for the operator. By being able to optimize the hose configuration for a particular situation or application, both the device and the operator will benefit. When the minimum amount of guide hose is used there is less friction between the guide hose and the cable. A lower friction reduces the amount of force the operator must apply to the feed mechanism and reduces the strain on the cable and drive train.

There are additional benefits to the modular guide hose system. By reducing the length of the guide hose the operator is able to use the additional length of cable that was otherwise in a guide hose. The work area taken up by the device can also be reduced by using the optimum length of guide hose.

FIGS. 1-6 illustrate an embodiment of a drum type drain cleaner 10 having a modular guide hose system 100 in accordance with the present subject matter. The cleaner 10 generally comprises a housing 20, one or more base member(s) 30 along a lower region of the housing for contacting a floor or ground, a rotatably powered drum 40 disposed within an outer drum housing 50, and a drum cover 70. The housing 20 provides a support ledge 22 which is configured to matingly engage an edge 71 of the drum cover 70, and in certain versions sealingly engage the edge 71 of the drum cover 70. As will be appreciated, a drain cleaning cable 14 is at least partially housed or stored by the drum 40 and outer drum housing 50. Rotation of the drum 40 in conjunction with provisions for advancing or retracting the drain cleaning cable such as a cable feed apparatus, results in administration of the cable 14 out of the drum assembly 40, 50; or retraction into the drum assembly.

The housing 20 generally encloses a motor (not shown) which is typically an electrically powered motor having a rotary output for providing powered rotation of the drum 40 and associated components. Also provided with and/or integrally formed with the housing 20 is a handle 24 that in many embodiments extends over a center of mass of the cleaner 10 to facilitate carrying or lifting of the cleaner 10 by an operator. The housing 20 can also include a sump 26 or other housing reservoir with a drain or removable plug 28. The sump 26 is typically in the form of a lowermost enclosed region of the housing 20 disposed below the drum 40 that serves to collect moisture, water, and debris. The drain 28 facilitates removal of such moisture, water, and/or debris from the sump 26, and specifically from an interior region of the sump 26.

The drain cleaner 10 typically additionally includes one or more controls and/or actuators 34 for governing or monitoring operation of the cleaner. The drain cleaner 10 may optionally include cord wrap provisions 38. In certain embodiments, the drain cleaner 10 may also include one or more provisions that provide feedback to an operator such as lights and/or gauges (not shown).

As will be understood, the drum 40 is rotatably powered by the motor and is typically in the form of a spool or cylinder. However, the present subject matter includes the use of other drum configurations such as for example, open frame carriages, polygonal configurations, and the like.

The drain cleaner 10 also includes the noted outer drum housing 50. The outer drum housing 50 defines a front 52, a rearwardly extending circumferential wall 56, and in many versions, an arcuate wall 54 extending between the front 52 and the circumferential wall 56. In many embodiments, the outer drum housing 50 defines one or more openings 58 which enable visual inspection of the drum 40 and/or a drain cleaning cable 14. The outer drum housing 50 depicted in the referenced figures is an example of an open drum housing. In certain versions of the outer drum housing 50, the housing defines at least two openings 58, at least three openings, at least four openings, at least five openings, and in particular versions six or more openings. The present subject matter includes the use of one or more viewing windows instead of or in addition to the noted openings.

The drain cleaner 10 also comprises a drum cover 70. The drum cover 70 may optionally include at least one open region such as an opening to thereby enable visual inspection of the outer drum housing 50 through the drum cover 70. However, in many embodiments, the drum cover 70 is free of any open regions and instead includes a transparent or visually clear region(s) to enable viewing of the outer drum housing 50 through the drum cover 70. As will be appreciated, with one or more openings in both the drum cover and the outer drum housing, water and/or debris would not be contained within the machine. The drum cover 70 includes a front 72, a rearwardly extending circumferential wall 76, and one or more wall regions extending between the front 72 and the circumferential wall 76. In certain versions, the one or more wall regions include a first conical wall **74*a* generally extending from and disposed immediately alongside the front 72, a second conical wall 74*b* generally extending from and disposed immediately alongside the circumferential wall 76, and a connecting ring wall portion 75 extending between the first conical wall 74*a* and the second conical wall 74*b*. It will be understood that in no way is the present subject matter limited to drum covers such as cover 70** having the particular configuration as described.

Instead, the present subject matter includes a wide array of shapes, sizes, and configurations of the drum cover 70.

The drain cleaner 10 also includes a cable port 90 through which the drain cleaning cable 14 is accessed. Typically, the port 90 is concentrically located and aligned with an axis of rotation of the drum 40.

The drum cover 70 is releasably attached to the housing 20 or other component(s) of the drain cleaner 10 by one or more cover affixment provisions such as 84 shown in the referenced figures.

Figure 3:
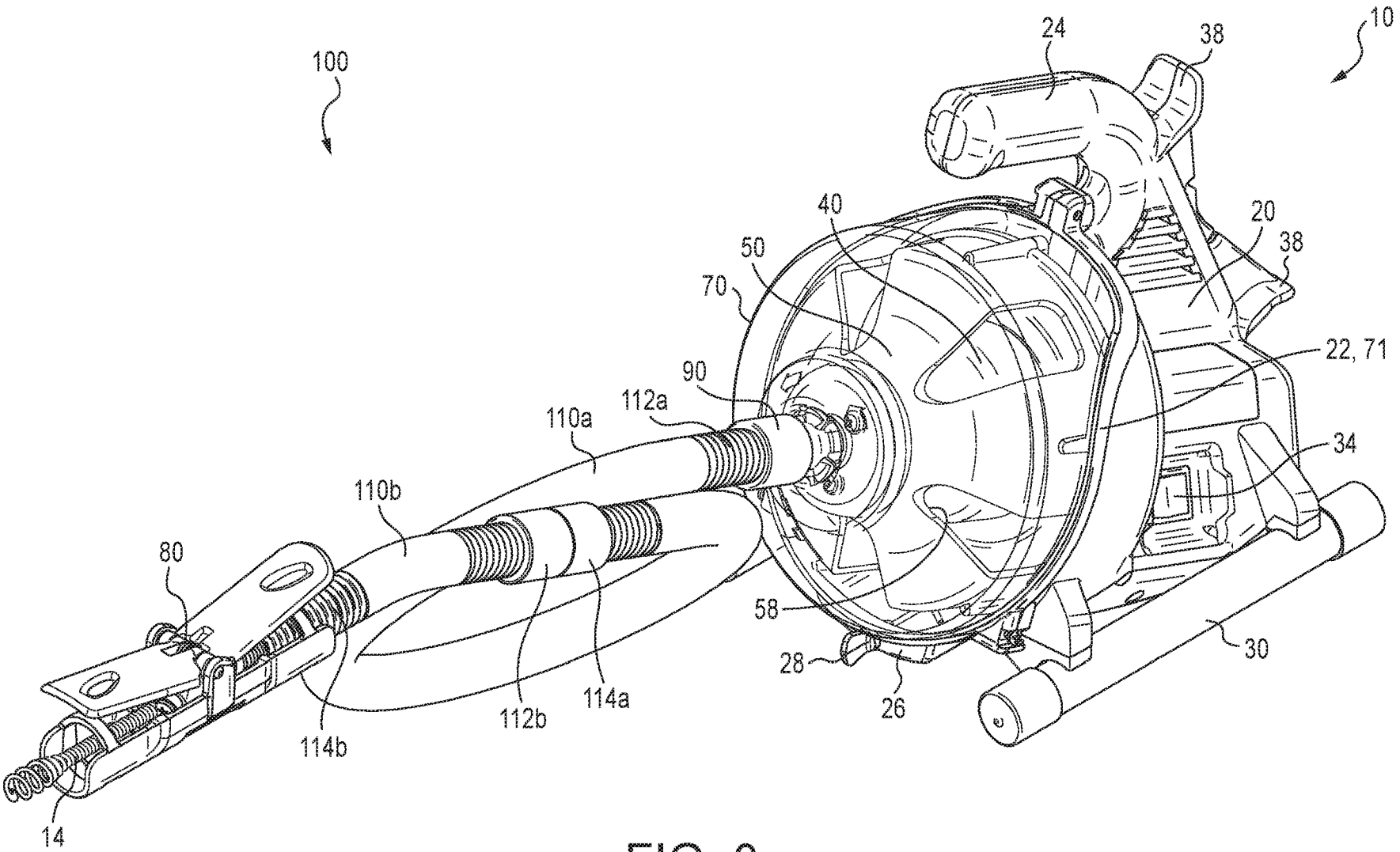
FIG. 3 is a perspective view of the drain cleaning tool of FIG. 1 with another configuration of a modular guide hose system in accordance with the present subject matter.
Figure 4:
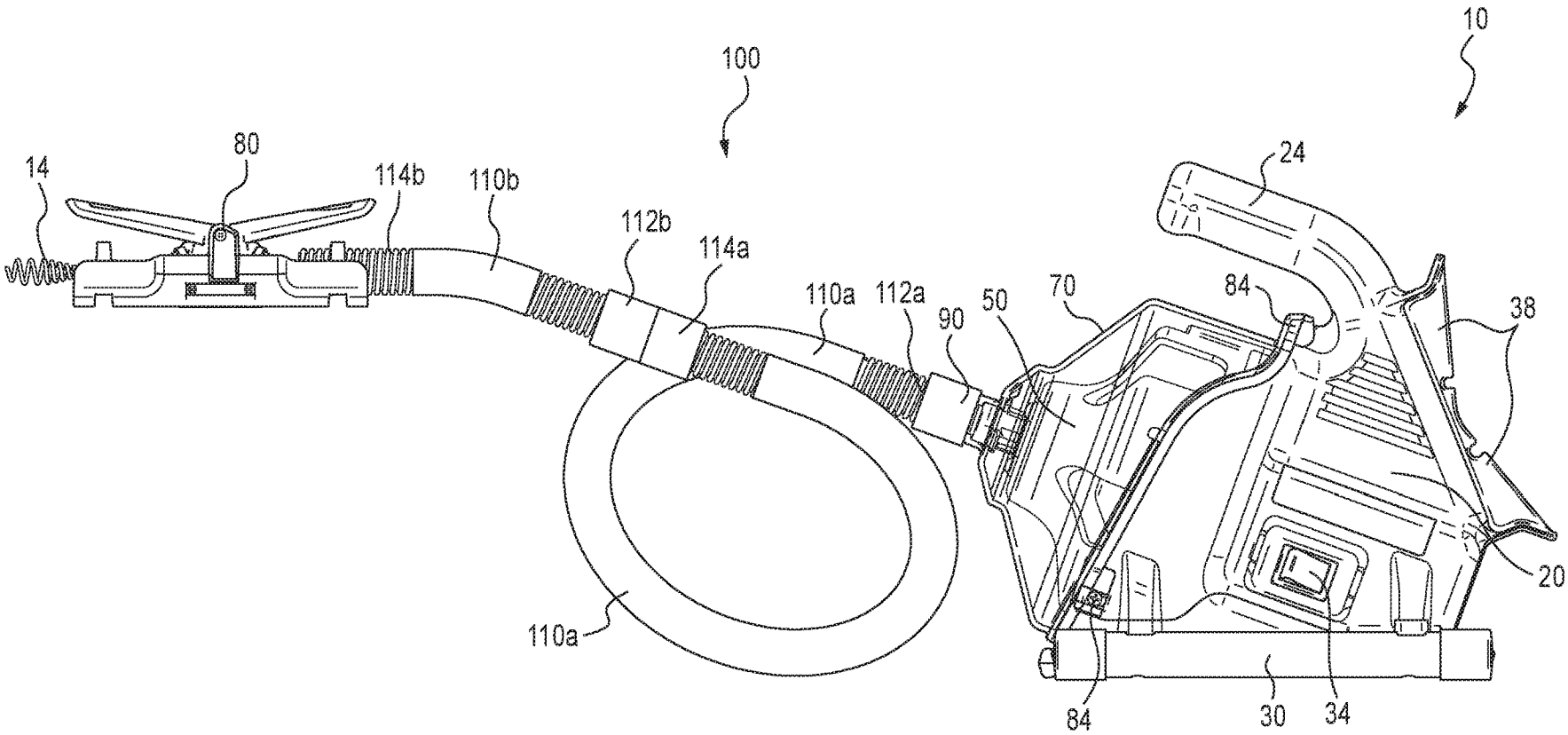
FIG. 4 is a side view of the drain cleaning tool and modular guide hose system depicted in FIG. 3.
Figure 5:
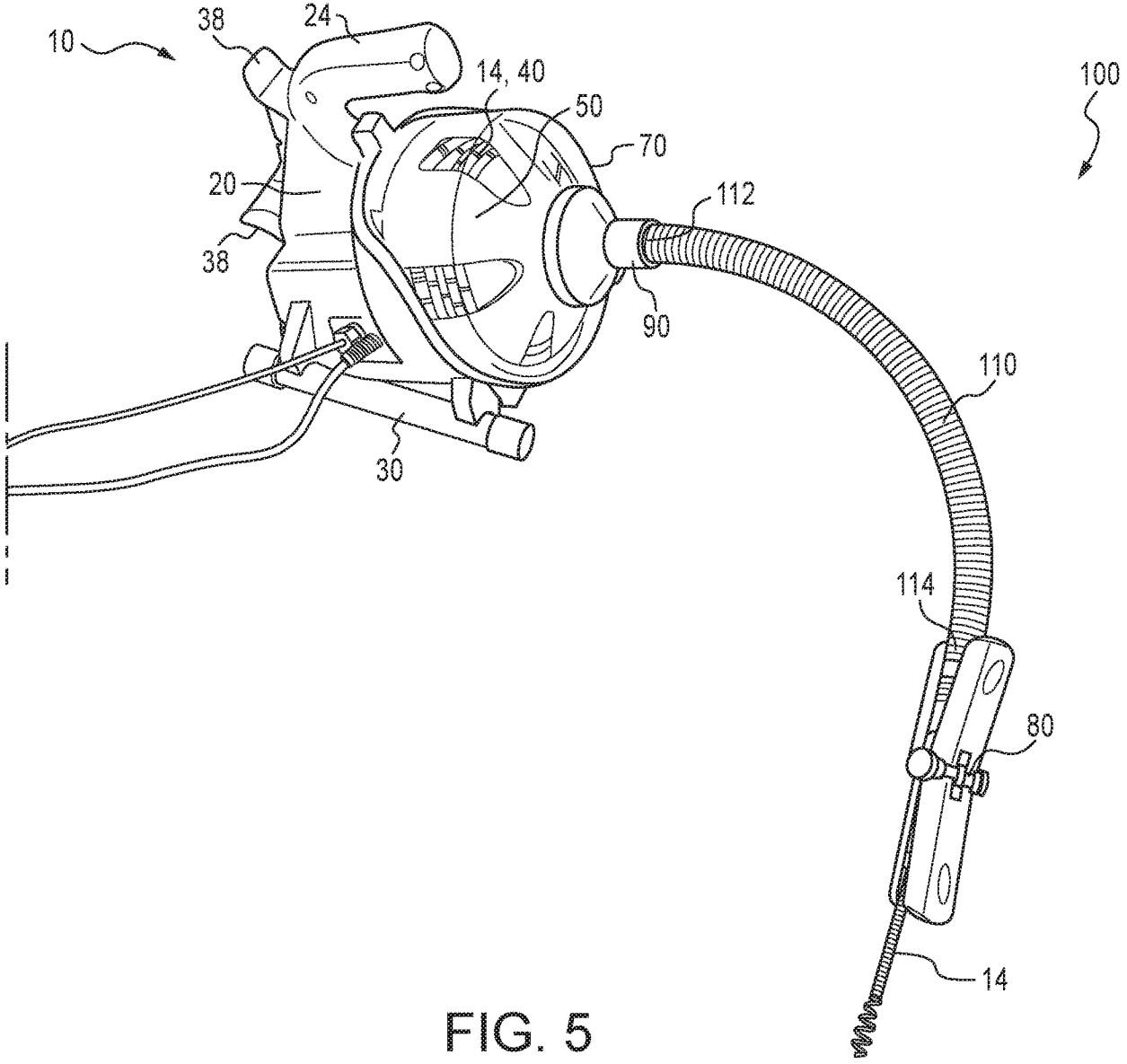
FIG. 5 is a perspective view of a drain cleaning tool of FIG. 1 with another configuration of a modular guide hose system in accordance with the present subject matter.
Figure 6:
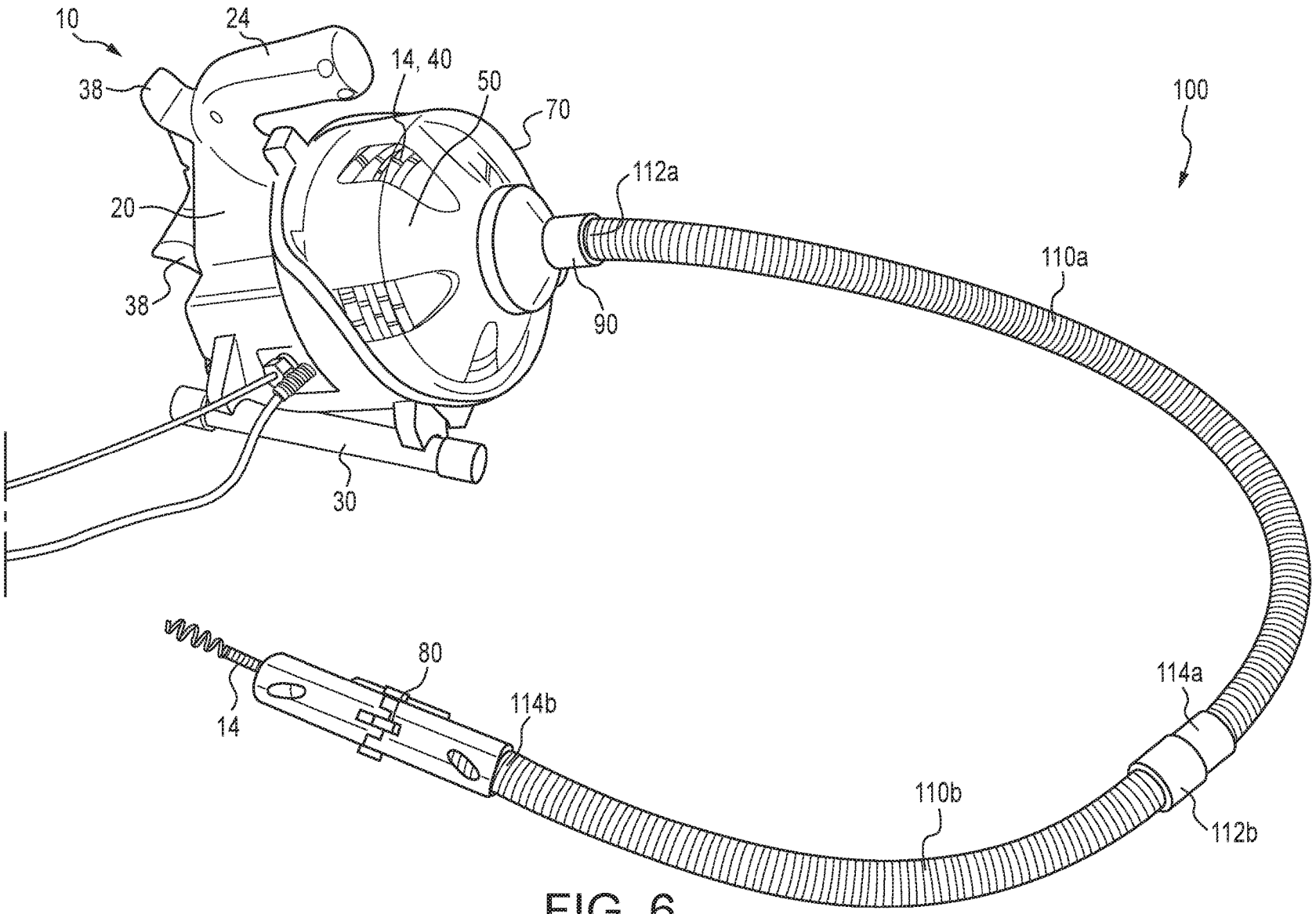
FIG. 6 is a perspective view of a drain cleaning tool of FIG. 1 with still another configuration of a modular guide hose system in accordance with the present subject matter.

The modular guide hose system 100 generally comprises at least one flexible hose section 110 and a cable feed apparatus 80. One or more hose sections 110 typically extend between the cable port 90 and the cable feed apparatus 80. Each hose section 110 defines a proximal end 112 and an opposite distal end 114 in which the proximal end is disposed closer to the drain cleaner 10 than the distal end. Thus, referring to FIGS. 1, 2, and 5 for example, the guide hose system 100 comprises a hose section 110 having a proximal end 112 engaged with the cable port 90 and an opposite distal end 114 engaged with the cable feed apparatus 80. In the guide hose system 100 shown in FIGS. 1 and 2, the hose section 110 is relatively short in length and shorter than the hose section 110 depicted in FIG. 5. Referring to FIGS. 3, 4, and 6 for example, the guide hose system 100 comprises a first hose section 110*a* having a proximal end 112*a* engaged with the cable port 90 and an opposite distal end 114*a* engaged with a proximal end 112*b* of a second hose section 110*b*. The second hose section 110*b* defines an opposite distal end 114*b* engaged with the cable feed apparatus 80. In the guide hose system 100 depicted in FIGS. 3 and 4, the second hose section 110*b* is relatively short in length, and shorter than the second hose section 110*b* shown in FIG. 6.

The hose sections such as 110, 110*a*, and 110*b*, are flexible and thus not rigid or otherwise formed to generally retain their shape. Instead, the flexible hose sections are pliant and can readily undertake a variety of different shapes without fracturing or cracking of their wall(s). Although flexible, the hose sections are configured such that they retain a circular cross sectional shape and do not excessively deform particularly during use.

The present subject matter also includes configurations of the guide hose system 100 in which the cable feed apparatus 80 is disposed between hose sections such as for example the first hose section 110*a* and the second hose section 110*b*. The present subject matter also includes configurations of the guide hose system 100 in which the cable feed apparatus 80 is disposed immediately adjacent to the drain cleaner 10 and between the drain cleaner 10 and one or more hose sections. And, the present subject matter includes guide hose systems 100 that comprise more than two guide hose sections such as three, four, five, or more. In such systems, the cable feed apparatus 80 can be located between any two adjacent hose sections, immediately adjacent to the drain cleaner 10, or at the distal end of the distal-most hose section.

Figure 7:
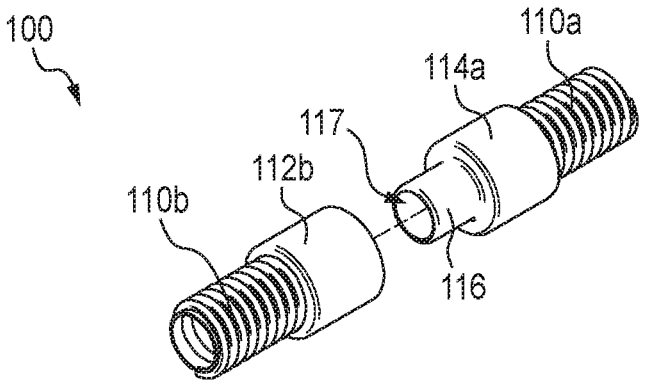
FIGS. 7 to 10 illustrate details of an embodiment of the modular guide hose system in accordance with the present subject matter.
Figure 8:
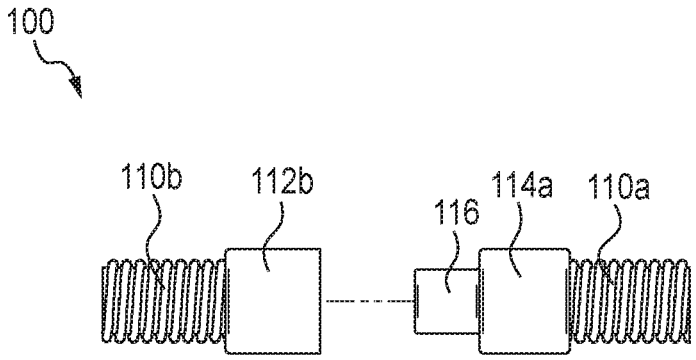

FIGS. 7 and 8 illustrate in greater detail selective coupling between a first hose section 110*a* and a second hose section 110*b* for example, in accordance with the present subject matter. In this version, the distal end 114*a* of the first hose section 110*a* includes an axial projection 116 defining an open end or aperture 117. The proximal end 112*b* of the second hose section 110*b* defines a receiving region sized and shaped to fittingly receive and engage the axial projection 116. Upon insertion of the projection 116 into the receiving region, the first and second hose sections 110*a* and 110*b* are releasably coupled together. Typically, frictional engagement between the contacting regions is sufficient to hold or retain the hose sections together until an operator decouples the hose sections from one another. However, the present subject matter includes the use of other engagement or retention assemblies such as mechanical assemblies, releasable catches, and/or detents.

Figure 9:
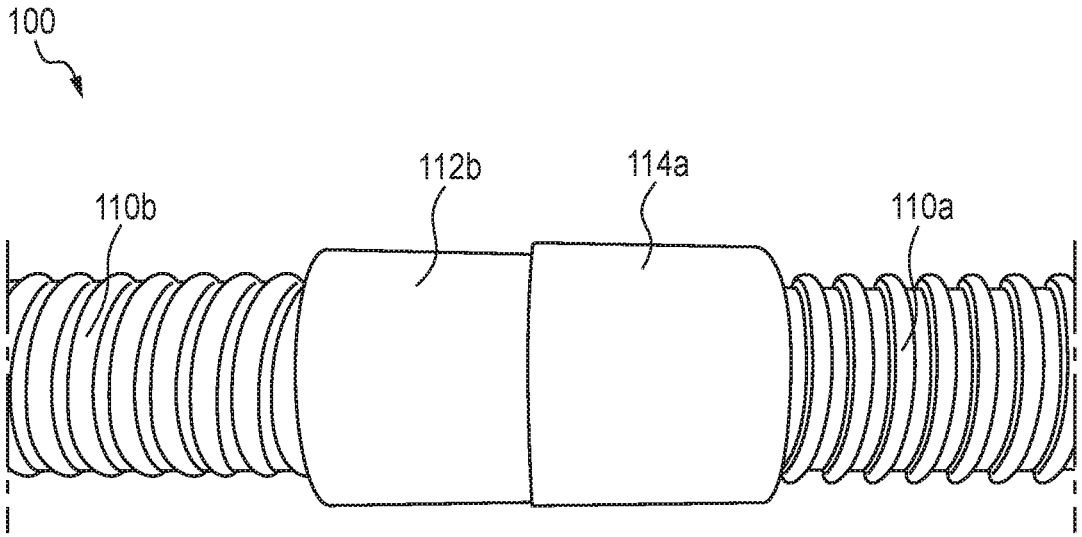
Figure 10:
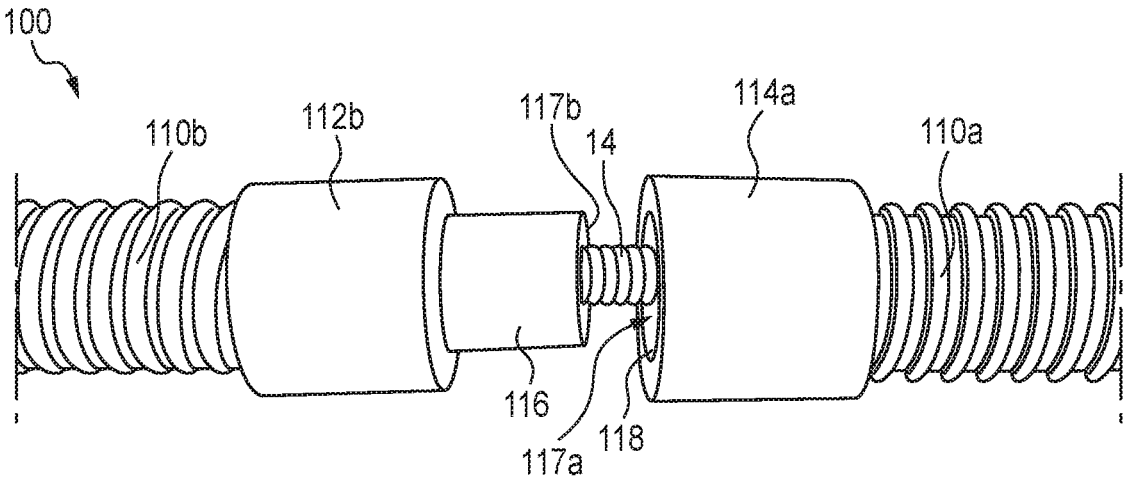

FIGS. 9 and 10 illustrate another version of selective coupling between a first hose section 110*a* and a second hose section 110*b* for example. The first hose section 110*a* defines a distal end 114*a* defining a receiving region 118 sized and shaped to fittingly receive and engage an axial projection 116 of the second hose section 110*b*. Ends 114*a* and 112*b* define apertures 117*a*, 117*b* respectively, that provide access to a hollow interior region defined along the length of each hose section. As will be understood, the drain cleaning cable 14 is disposed within and extends along the hollow interior region(s) defined in the hose section(s).

Although the present subject matter is described herein in conjunction with a motor driven drum type drain cleaner, it will be understood that the present subject matter can be used in association with manually powered plumbing tools using flexible drain cleaning cables, and other types of motor driven drain cleaners.

The hose section(s) can also be configured such that their ends such as a proximal end and/or a distal end, is tailored to engage a cable feed apparatus 80. The engagement is selectively releasable until for example, an operator disengages one or more hose section(s) from the cable feed apparatus 80.

Many other benefits will no doubt become apparent from future application and development of this technology.

All patents, applications, standards, and articles noted herein are hereby incorporated by reference in their entirety.

The present subject matter includes all operable combinations of features and aspects described herein. Thus, for example if one feature is described in association with an embodiment and another feature is described in association with another embodiment, it will be understood that the present subject matter includes embodiments having a combination of these features.

As described hereinabove, the present subject matter solves many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. In a drain cleaning system comprising: a drain cleaning device (10) including a rotatable drum (40) and a flexible drain cleaning cable (14) advanceable from the drum (40); wherein the improvement comprises:

a first bi-ended flexible guide hose (110*a*), one of the ends (112*a*) of the first flexible guide hose (110*a*) being coupled to the drain cleaning device (10), the first flexible guide hose (110*a*) being positioned for housing the drain cleaning cable (14) being advanced from the drum (40);

a second bi-ended flexible guide hose (110*b*), one of the ends (112*b*) of the second flexible guide hose (110*b*) being selectively and releasably coupled to the other end (114*a*) of the first flexible guide hose (110*a*) through frictional engagement of contacting surface portions therebetween;

wherein the frictional engagement of the contacting surface portions is provided by a male coupling member (112*b*) on one of the first and second guide hoses (110*a*, 110*b*) and an associated female coupling member (114*a*) on the other of the first and second guide hoses (110*a*, 110*b*);

wherein the male coupling member (112*b*) includes a coupling portion defining an axial projection (116) of predetermined length, the axial projection (116) having a substantially uniform diameter and a substantially uniformly-smooth exterior surface substantially along its length; and wherein the female coupling member (114*a*) includes a coupling portion defining a hollow region configured to receive the axial projection (116) of the male coupling member (112*b*).

2. The drain cleaning system of claim 1 wherein the rotatable drum (40) is electrically powered; and wherein the drain cleaning device (10) includes a cable port (90) through which the drain cleaning cable (14) is accessed.

3. In a drain cleaning system comprising: a drain cleaning device (10) including a rotatable drum (40) and a flexible drain cleaning cable (14) advanceable from the drum (40); wherein the improvement comprises:

a modular guide hose system (100) comprising a plurality of flexible bi-ended guide hose sections, wherein one of the ends (112*a*) of a first one (110*a*) of the plurality of flexible bi-ended guide hose sections is coupled to the drain cleaning device (10), the first one (110*a*) of the plurality of flexible guide hose sections being positioned for housing the drain cleaning cable (14) being advanced from the drum (40);

wherein one of the ends (112*b*) of a second one (110*b*) of the plurality of bi-ended flexible guide hose sections is selectively and releasably coupled to the other end (114*a*) of the first one (110*a*) of the flexible bi-ended guide hose sections through frictional engagement of contacting surface portions therebetween;

wherein the frictional engagement of the contacting surface portions is provided by a male coupling member (112*b*) on one of the first and second guide hose sections (110*b*) of the plurality of bi-ended flexible guide hose sections and an associated female coupling member (114*a*) on the other of the first and second guide hose sections (110*a*) of the plurality of flexible bi-ended guide hose sections wherein the male coupling member (112*b*) includes a coupling portion defining an axial projection (116) of predetermined length, the axial projection (116) having a substantially uniform diameter and a substantially uniformly-smooth exterior surface substantially along its length; and wherein the female coupling member (114*a*) includes a coupling portion defining a hollow region configured to receive the axial projection (116) of the male coupling member (112*b*).

4. The drain cleaning system of claim 3 wherein the modular guide hose system (100) includes three flexible bi-ended guide hose sections.

5. The drain cleaning system of claim 3 wherein the modular guide hose system (100) includes four flexible bi-ended guide hose sections.

6. The drain cleaning system of claim 3 wherein the modular guide hose system (100) includes five flexible bi-ended guide hose sections.

7. The drain cleaning system of claim 3 wherein the rotatable drum (40) is electrically powered; and wherein the drain cleaning device (10) includes a cable port (90) through which the drain cleaning cable (14) is accessed.

8. The drain cleaning system of claim 7, wherein the modular guide hose system (100) includes a cable feed apparatus (80), wherein one or more of the plurality of flexible bi-ended guide hose sections extends between the cable port (90) and the cable feed apparatus (80).

* * * * *